US005574240A

United States Patent [19]

Cartwright

[11] Patent Number: 5,574,240

[45] Date of Patent: Nov. 12, 1996

[54] PROPELLANTS USEFUL IN ELECTROTHERMAL-CHEMICAL GUNS

[75] Inventor: Richard V. Cartwright, Wantage, N.J.

[73] Assignee: Hercules Incorporated, Wilmington, Del.

[21] Appl. No.: 593,537

[22] Filed: Jan. 29, 1996

Related U.S. Application Data

[63] Continuation of Ser. No. 986,228, Dec. 7, 1992, abandoned.

[51] Int. Cl.[6] ..... F41F 1/00; C06B 31/28

[52] U.S. Cl. ..... 89/8; 124/3; 149/46; 149/93; 149/96

[58] Field of Search ..... 89/8; 124/3; 149/46, 149/93, 96

[56] References Cited

U.S. PATENT DOCUMENTS

| | | | |
|---|---|---|---|
| 3,318,244 | 5/1967 | Rostocil | 102/38 |
| 3,348,079 | 10/1967 | McKinnon | 310/11 |
| 3,374,668 | 3/1968 | Godfrey | 73/147 |
| 3,411,403 | 11/1968 | Rodenberger | 89/8 |
| 3,418,878 | 12/1968 | Stricklin | 89/8 |
| 3,553,503 | 6/1971 | O'Hare | 310/11 |
| 3,621,916 | 11/1971 | Smith, Jr. | 175/4.6 X |
| 4,370,576 | 1/1983 | Foster, Jr. et al. | 310/10 |
| 4,711,154 | 12/1987 | Chryssomallis et al. | 89/7 |
| 4,788,913 | 12/1988 | Stroud et al. | 102/202.5 |
| 4,895,062 | 1/1990 | Chryssomallis et al. | 89/7 |
| 5,072,647 | 12/1991 | Goldstein et al. | 89/8 |
| 5,171,932 | 12/1992 | McElroy | 89/8 |
| 5,188,682 | 2/1993 | Lochner et al. | 49/1 |

FOREIGN PATENT DOCUMENTS

| | | | |
|---|---|---|---|
| 382000 | of 0000 | European Pat. Off. . | |
| 220556 | 5/1987 | European Pat. Off. | 89/8 |
| 1917191 | of 0000 | Germany . | |
| 1105663 | 3/1968 | United Kingdom | 89/8 |

OTHER PUBLICATIONS

Oberle, W. and Morelli, W., "Current Activities in Electrothermal–Chemical Gun Propulsion In The United States", 1991; pp. 75–85.

Oberle, W. F., and Bunte, S. W., "A Thermochemical Analysis of Proposed Working Fluids For Electrothermal Guns", Jun. 1989; pp. 1–45.

*Primary Examiner*—Peter A. Nelson
*Attorney, Agent, or Firm*—Haugen and Nikolai, P.A.

[57] ABSTRACT

The present invention provides a propellant for electrothermal-chemical guns comprising a dispersion of one or more energetic solids in an energetic liquid phase. The energetic solid is preferably a nitramine such as cyclotrimethylenetrinitramine (RDX) and the energetic liquid component is preferably a homogeneous liquid that is either aqueous or non-aqueous. Aqueous liquid phases suitable for use in the present invention include concentrated solutions containing at least one nitrate salt. Non-aqueous liquid phases suitable for use include those that contain nitrate ester, nitramine, nitro or azido compounds or mixtures thereof.

These propellants provide a high level of energy density because of the use of energetic ingredients and the high loading density allowed with a liquid propellant. The presence of a dispersed solid phase within the continuous liquid phase also permits control of the burning behavior of the propellant by variation of the interfacial area between phases.

35 Claims, No Drawings

PROPELLANTS USEFUL IN ELECTROTHERMAL-CHEMICAL GUNS

This is a continuation of application Ser. No. 08/986,228, filed on Dec. 7, 1992, and now abandoned.

The present invention relates to propellants useful in electrothermal-chemical guns. More specifically, the present invention relates to propellants that are useful in guns that use a combination of chemical propellants and electrical energy.

BACKGROUND OF THE INVENTION

An apparatus or gun for providing a controlled increase in muzzle velocity of a projectile while maintaining a safe maximum gas pressure inside a gun barrel has been developed during the past few years. The apparatus is a hybrid unit combining the technologies of liquid propellant with electrothermal technologies that avoids the disadvantages of these technologies when employed separately.

An elongated barrel is used in traditional guns, having a central bore closed at a breech end. A projectile is moved through the bore by heated gases produced by a burning propellant fired by an igniter. The burning propellant produces a relatively high pressure against the projectile when it is initially ignited, but the pressure decreases as the projectile moves along the gun barrel bore. Liquid fuel can be used to provide a more even pressure as the projectile moves, but it requires a critical fuel chamber size, bore diameter and manner of ignition of the fuel.

In liquid bipropellant technology one or more fluids are combined to generate a chemical reaction that produces pressure to power a projectile. The metering and mixing of the two fluids is difficult to control and therefore is subject to the risk of catastrophic failure or at least is subject to erratic performance. Mechanical means usually require seal and metering technology which is unreliable and so expensive as to be unjustifiable in a high production environment.

Electrothermal propulsion is a new technology that utilizes the electrical output of an inductive or capacitive network which condenses a pulse from an electrical generating source and energizes the system. Dielectric breakdown plasma is directed to a chamber containing an inert working fluid which vaporizes to provide gas pressure to eject or propel a projectile. All of the projectile energy is derived from the electrical power pulse. The resulting device is extremely bulky due to the excessive size of the electrical power supply which makes the unit difficult to integrate with projectile launchers.

The electrothermal-chemical (ETC) gun, which is employed with the propellants of the present invention, is in principle capable of providing significantly enhanced performance in comparison to guns utilizing chemical propellants alone, because the combination of electrical and chemical energy can provide a greater overall energy density and because the method by which the electrical energy is applied can be tailored to optimize the burning of the chemical propellant. The ETC concept is believed to provide the potential of increased muzzle kinetic energy (increased velocity at launch) within the constraints of the geometric configurations of current guns.

A genetic ETC gun works as follows: There is the discharge of a large electrical current from a power source into a plasma capillary, where a fuse wire is vaporized to create a high temperature (10,000°–20,000° K.) gas plasma. The vaporized plasma provides a narrow jet of ionized gas which vaporizes and entrains a portion of the fuel and causes the fuel to combine with a portion of an oxidizer material. The power supply continues to supply energy which controls the rate of vaporization of the plasma base and thus controls the rate of combustion of the oxidizer material and the fuel. Portions of the oxidizer material and fuel are launched and travel behind the projectile. Combustion of the travelling liquid phase occurs behind the projectile during the time it takes the projectile to move through the gun barrel. The combustion energy released by the travelling liquid causes pressure against the projectile to remain relatively constant as the projectile moves along the length of the gun barrel. This allows the breech and chamber pressures to be relatively low and still provide a high velocity projectile at the gun muzzle. As the electrical current continues to flow, the plasma temperature is maintained by ohmic heating. Wall material (such as polyethylene) is ablated because of the high temperatures. The pressure gradient between plasma capillary and combustion chamber forces the plasma to flow into the combustion chamber where it reacts with a propellant and generates hot gas, which is the working fluid that accelerates the projectile. The major purpose of the use of the electrical energy is to control the gas generation rate and the subsequent pressure history in the gun.

An electrothermal-chemical gun of the type that can be employed in the practice of the present invention is described in U.S. Pat. Nos. 4,711,154 and 4,895,062, that are incorporated herein in their entirety. In these patents the gun is referred to as a combustion augmented plasma (CAP) device that uses a plasma cartridge to controllably inject fuel into an oxidizer chamber. The plasma cartridge functions as an electric feed pump whose injection rate is controlled by the power applied to the plasma cartridge. The chemical reaction of the oxidizer with fuel supplied by the plasma feed pump provides the principal source of energy for generation or amplification of pressure. The uses of such generated pressure include the production of an impact force or the generation of a controlled pressure increase for use in propelling a projectile.

Chemical propellants having a high energy density are generally more useful in ETC gun systems since such propellants require correspondingly less electrical energy. Liquid propellants containing energetic ingredients are especially advantageous in comparison to the granulated solid propellants used in conventional guns, because a liquid can be loaded into a gun chamber with essentially no void volume, thus providing a higher energy density.

Previous research into liquid gun propellants that are ignited by conventional primers has proven unsuccessful because of uncontrollable and erratic behavior of the liquid. When no plasma discharge is present, the burning behavior of the liquid depends entirely on the hydrodynamic generation of surface area, which tends to be subject to random fluctuations. However, control of the plasma through design of the electrical pulse-forming network can largely overcome the effects of hydrodynamic fluctuations.

The more energetic liquid propellants found in the state of the art prior to the present invention, including the above references, consist of combinations of fuels and oxidizers. The oxidizers comprise either hydroxylammonium nitrate (HAN) or hydrogen peroxide. These oxidizers have the disadvantage that small amounts of certain impurities can catalyze their decomposition. Consequently, if propellants containing these oxidizers become contaminated in the course of handling or long term storage, their performance can be seriously compromised. In addition, HAN evolves small quantities of nitrogen oxides on storage, which can react with various organic compounds to adversely affect stability.

It is desirable for ETC propellants to have a high energy density and good long term stability under practical conditions of handling and storage. At the same time, ballistic performance must be acceptable. That is, the combination of chemical and electrical energy must be sufficient to provide the required projectile velocity and kinetic energy, while keeping pressure below a level that may damage the gun. A desirable kinetic energy level with a 30 mm gun is about 200 kilojoules. The maximum desired pressure depends upon the type of projectile being used. The maximum pressure with a noninstrumented projectile is about 500 MPa, while the maximum pressure with an instrumented or "smart" projectile is about 220 MPa. Control of the maximum pressure can be achieved by designing the propellant and electrical systems so as to limit the rate of pressure increase due to propellant burning. ETC propellants must be able to interact with electrical discharges to allow a relatively high level of pressure to be sustained in the gun as the projectile accelerates. This effect would permit the optimal level of ballistic performance to be achieved from a given size of gun. It is essential to tailor the physical and chemical properties of the propellant to provide good burning characteristics with electrical discharges produced under practical conditions. Propellants for the ETC gun application must also have consistent or controllable performance over a wide range of ambient temperatures. The propellant should be capable of being used at a low temperature, preferably as low as –40° C. The propellant must also be sufficiently resistant to thermal decomposition so that it can be used and stored at high temperatures, preferably as high as 60° C. In addition, it must not be capable of detonation under conditions of gun firing.

SUMMARY OF THE INVENTION

The present invention provides a propellant for electrothermal-chemical guns comprising a dispersion of one or more energetic solids in an energetic liquid phase. The burning behavior of the propellant is controlled by the interfacial area between phases. The energetic solid is preferably a nitramine such as cyclotrimethylene-trinitramine (RDX) and the energetic liquid component is preferably a homogeneous liquid. A homogeneous liquid can be either aqueous or non-aqueous. Aqueous liquid phases suitable for use in the present invention include concentrated solutions containing at least one nitrate salt. Non-aqueous liquid phases suitable for use include those that contain nitrate ester, nitramine, nitro or azido compounds, or mixtures thereof. The present invention also provides for an electrothermal-chemical gun system comprising an electrothermal-chemical gun containing the propellants of the present invention.

The propellants of the invention provide a high level of energy density because of the use of energetic ingredients and the high loading density allowed with a liquid propellant. The presence of a dispersed solid phase within the continuous liquid phase also permits control of the burning behavior of the propellant by variation of the interfacial area between phases since the burning rate is directly proportional to the surface area of the solid phase.

DETAILED DESCRIPTION OF THE INVENTION

The present invention provides a propellant for electrothermal-chemical guns comprising a dispersion of one or more energetic solids in an energetic liquid phase. In addition, the present invention comprises an electrothermal-chemical gun system comprising the use of the propellants of the present invention in an electrothermal-chemical gun.

The burning behavior of the propellant of the present invention is controlled by the interfacial area between phases. The energetic solid is preferably a nitramine such as cyclotrimethylene-trinitramine (RDX) or cyclotetramethylenetetranitramine (HMX). Other energetic solids such as nitrocellulose, nitroguanidine, ammonium nitrate, pentaerythritol tetranitrate (PETN), trinitrotoluene (TNT) or triaminotrinitrobenzene (TATB) are also useful for this purpose.

The energetic liquid phase is preferably a homogeneous liquid, although it can be an emulsion. A homogeneous liquid can be either aqueous or non-aqueous. In addition to the energetic solid that is dispersed in the energetic liquid, the liquid can contain one or more dissolved solids such as any of the energetic solids listed above. The dissolved solid may be different from the dispersed solid or may be the same as where sufficient energetic solid is added to the energetic liquid phase to produce a saturated solution. A preferred energetic solid that is dissolved in the energetic liquid is N-methyl-N-(2-nitroxyethyl)nitramine (MeNENA). Aqueous liquid phases suitable for use in the present invention include concentrated solutions containing at least one nitrate salt, such as ammonium nitrate, N-methylammonium nitrate, N-ethylammonium nitrate, ethylenediamine dinitrate or N-(2-hydroxyethyl) ammonium nitrate. Preferably, said nitrate salts comprise more than 50 percent by weight of said concentrated solutions. A non-aqueous liquid phase can comprise one or more nitrate ester, nitramine, nitro or azido compounds. Examples of such nitrate ester, nitramine, nitro and azido compounds include diethylene glycol dinitrate (DEGDN), nitroglycerin, 1,2,4-butanetriol trinitrate (BTTN), trimethylolethane trinitrate (TMETN), N-ethyl-N-(2-nitroxyethyl)nitramine (EtNENA), N-butyl-N-(2-nitroxyethyl)nitramine (BuNENA), a 1:1 mixture of bis(2,2-dinitropropyl)acetal and bis(2,2-dinitropropyl)formal (BDNPA/F), nitromethane, nitroethane, 1-nitropropane, 2-nitropropane, poly(glycidyl azide) or 1,5-diazido-3-nitrazapentane.

The propellants of the present invention comprise from 20–60% by weight dispersed energetic solid and preferably 30–50% by weight. If too little energetic solid is added, then there is less control over the burning behavior of the propellant and if too much energetic solid is added, the propellant is too viscous for its intended use.

It is theoretically possible for an emulsion containing oxidizer dispersed in fuel to be employed. However, in practice its stability is likely to be unacceptable because of coalescence when stored for a long time.

It may be necessary to combine two or more energetic liquids in order to obtain a low enough freezing point to make a useful propellant. A non-energetic liquid may also be present if the propellant would otherwise be too sensitive to allow safe production and usage.

Other ingredients, present in relatively low proportions, may be necessary or desirable for practical utility. Stabilizers commonly used in nitrate ester solid propellants may also be used in these propellants. A low level (<1%) of carbon black may be added as an opacifier, to reduce in-depth burning and thus provide better control over the burning rate. A thickener may be added to prevent settling of the dispersed solids. Guar gum, or a derivative of guar gum, may be used for this purpose with an aqueous liquid phase; nitrocellulose may be used with a non-aqueous liquid phase.

The propellants of the invention provide a high level of energy density because of the use of energetic ingredients and the high loading density allowed with a liquid propellant. The presence of a dispersed solid phase within the continuous liquid phase also permits control of the burning behavior of the propellant by variation of the interfacial area between phases. The ballistic performance of an electrothermal-chemical gun propellant of the present invention must be such that the projectile achieves a high velocity without excessive pressure within the gun. The propellant must also be energetic enough so that electrical energy requirements are not excessive. In practice the required ballistic performance with no more than about 1.0 kilojoule (kJ) of electrical energy per gram of propellant. In addition, the burning behavior of the propellant must be sufficiently well-controlled that the desired profile of pressure as a function of time can be achieved by appropriate variation in the amount of electrical energy and the manner in which it is input.

It is expected that the present invention will be useful in high performance guns to defend costly or strategically important facilities.

EXAMPLE 1

Propellant with Non-Aqueous Liquid Phase

N-butyl-N-(2-nitroxyethyl)nitramine (1458 g) and nitrocellulose (30 g) were mixed and heated together at 65° C. for 24 hours. The resulting liquid had a soft gelatinous consistency. A total of 900 grams cyclotrimethylenetrinitramine which had been premixed with 100 grams water, 12 grams ethyl centralite (stabilizer) and 5 grams Monarch 120 (trademark of Cabot Corporation) carbon black were added to the liquid. The resulting mixture was agitated for 85 minutes at 20° C. in a 5-quart Hobart planetary vertical mixer.

Various weights of this propellant were then loaded into cartridges of the appropriate size to fit into a 30 mm gun chamber. The cartridges were then inserted into a 30 mm gun which had a barrel length of 1.71 meters and was equipped with a plasma injection cartridge. The gun was fired using various electrical energy inputs and projectiles of various weights. The results obtained are shown in Table 1.

TABLE 1

| Propellant Charge Weight, grams | Electrical Energy Input Kilojoules | Projectile Weight grams | Maximum Pressure MPa | Projectile Velocity km/sec |
|---|---|---|---|---|
| 203.4 | 150 | 175.5 | 186 | 1.196 |
| 201.4 | 114 | 223.7 | 152 | 1.054 |
| 207.1 | 121 | 274.0 | 159 | 0.927 |
| 202.5 | 132 | 275.4 | 186 | 0.997 |
| 201.2 | 117 | 338.8 | 179 | 0.891 |

The time dependence of pressure for the first and second firings in the above table respectively were recorded by piezoelectric transducers which showed that the areas of maximum pressure are remarkably flat. The absence of a sharp pressure peak shows that pressurization from a combination of electrical discharge and propellant burning is effective in sustaining a relatively high level of pressure as the projectile accelerates. This effect results in a high level of ballistic performance from a given gun.

EXAMPLE 2

Insensitivity Demonstration

The propellant composition of Example 1 was subjected to a lead block compression test. A cylindrical shell two inches in diameter and two inches in height was filled with propellant. A No. 8 blasting cap was then inserted, with its head just below the top surface of the propellant. A solid lead cylinder 1.5 inches in diameter and two inches in height was placed on a mild steel plate which was 12 inches long, 12 inches wide and 0.5 inch thick. The cylinder of propellant was placed on top of the lead cylinder and the blasting cap was then fired. The resulting compression of the lead cylinder was measured. Three tests yielded an average of 0.002 inch of compression. Prior experience has shown that a detonable propellant will produce at least 0.125 inch of compression. The test propellant was thus shown to be non-detonable according to the lead block compression test.

The propellant of Example 1 was also subjected to a heavy confinement sensitivity test. A centered hole one inch in diameter and 28 inches in length was drilled into a steel cylinder of three inches outside diameter and 30 inches length. The resulting tube was heat-treated to hardness of at least 30 (Rockwell C). The cylinder was filled with the propellant of Example 1 with a No. 6 blasting cap at the bottom. The blasting cap was then fired. The tube remained intact, although its circumference increased by 0.016 inch. The absence of fragmentation of the tube demonstrated that the propellant is nondetonable under heavy confinement.

EXAMPLE 3

Propellant With Aqueous Liquid Phase

A total of 1247 g of N-(2-hydroxyethyl)ammonium nitrate, 416 g of N-methylammonium nitrate, 367 g of ammonium nitrate and 265 g water were combined to make a solution. Into the solution was dispersed 23 g of hydroxypropyl guar gum. Dissolution of the gum was completed by heating at 65° C. for two days. The resulting liquid had a soft, gelatinous consistency. A total of 1282 g of 10%-water-wet RDX and 7 g Monarch 120 carbon black were added to it. Mixing was accomplished in the same manner as Example 1.

A weight of 100 g of this propellant was charged to a 30 mm cartridge, which was loaded into a 30 mm CAP gun and fired using 198 kJ of electrical energy and a projectile weighing 197.8 g. The maximum chamber pressure in this firing was 381 MPa. The projectile exited the gun with a velocity of 1.44 km/sec.

I claim:

1. An electrothermal-chemical gun chemical propellant comprising a self-contained stable dispersion of at least one energetic solid in at least one energetic liquid phase, said stable dispersion being established prior to deployment of said propellant.

2. The propellant of claim 1 wherein said energetic solid is selected from the group consisting of nitramines, nitrocellulose, nitroguanidine, ammonium nitrate, pentaerythritol tetranitrate (PETN), trinitrotoluene (TNT) and triaminotrinitrobenzene (TATB).

3. The propellant of claim 1 wherein said energetic liquid phase comprises a homogeneous liquid.

4. The propellant of claim 1 wherein said dispersed energetic solid comprises about 20–60 percent by weight of said propellant.

5. The propellant of claim 4 wherein said dispersed energetic solid comprises about 30–50 percent by weight of said propellant.

6. The propellant of claim 3 wherein said homogeneous liquid further comprises at least one energetic solid dissolved in said homogeneous liquid.

7. The propellant of claim 6 wherein said dissolved energetic solid is selected from the group consisting of nitramines, nitrocellulose, nitroguanidine, ammonium nitrate, pentaerythritol tetranitrate (PETN), trinitrotoluene (TNT) and triaminotrinitrobenzene (TATB).

8. The propellant of claim 7 wherein said dissolved energetic solid is N-methyl-N-(2-nitroxyethyl)nitramine (MeNENA).

9. The propellant of claim 2 wherein said dispersed energetic solid is selected from the group consisting of cyclotrimethylenetrinitramine (RDX) and cyclotetramethylenetetranitramine (HMX).

10. The propellant of claim 1 further comprising a thickener.

11. The propellant of claim 3 wherein said homogeneous liquid comprises an aqueous liquid phase which comprises a concentrated solution containing at least one nitrate salt.

12. The propellant of claim 11 wherein more than 50 percent by weight of said aqueous liquid phase is said nitrate salt.

13. The propellant of claim 11 wherein said nitrate salt is selected from the group consisting of ammonium nitrate, N-methylammonium nitrate, N-ethylammonium nitrate, ethylenediamine dinitrate and N-(2-hydroxyethyl) ammonium nitrate.

14. The propellant of claim 11 further comprising a thickener selected from the group consisting of guar gum and derivatives of guar gum.

15. The propellant of claim 3 wherein said homogeneous liquid comprises a non-aqueous liquid phase comprising at least one compound selected from the group consisting of nitrate ester, nitramine, nitro or azido compounds.

16. The propellant of claim 15 wherein said non-aqueous liquid phase comprises at least one compound selected from the group consisting of diethylene glycol dinitrate (DEGDN), nitroglycerin, 1,2,4-butanetriol trinitrate (BTTN), trimethylolethane trinitrate (TMETN), N-ethyl-N-(2-nitroxyethyl)nitramine (EtNENA), N-butyl-N-(2-nitroxyethyl)nitramine (BuNENA), a 1:1 mixture of bis(2,2-dinitropropyl)acetal and bis(2,2-dinitropropyl)formal (BDNPA/F), nitromethane, nitroethane, 1-nitropropane, 2-nitropropane, poly(glycidyl azide) and 1,5-diazido-3-nitrazapentane.

17. The propellant of claim 15 wherein said non-aqueous liquid phase further comprises a thickener.

18. The propellant of claim 17 wherein said thickener is nitrocellulose.

19. An electrothermal-chemical gun chemical propellant comprising a dispersion of at least one energetic solid in at least one energetic liquid phase wherein said energetic solid is selected from the group consisting of nitramines, nitrocellulose, nitroguanidine, ammonium nitrate, pentaerythritol tetranitrate (PETN), trinitrotoluene (TNT) and triaminotrinitrobenzene (TATB) and said energetic liquid phase comprises a homogeneous liquid.

20. The propellant of claim 19 wherein said dispersed energetic solid is selected from the group consisting of cyclotrimethylenetrinitramine (RDX) and cyclotetramethylenetetranitramine (HMX) and said homogeneous liquid comprises an aqueous liquid phase which comprises a concentrated solution containing at least one nitrate salt selected from the group consisting of ammonium nitrate, N-methylammonium nitrate, N-ethylammonium nitrate, ethylenediamine dinitrate and N-(2-hydroxyethyl) ammonium nitrate.

21. The propellant of claim 19 wherein said liquid phase further comprises a thickener, wherein when said liquid phase comprises an aqueous liquid phase said thickener is selected from the group consisting of guar gum and derivatives of guar gum and when said liquid phase comprises a nonaqueous liquid phase said thickener is nitrocellulose.

22. The propellant of claim 19 wherein said homogeneous liquid comprises a non-aqueous liquid phase comprising at least one compound selected from the group consisting of nitrate ester, nitramine, nitro or azido compounds.

23. The propellant of claim 22 wherein said non-aqueous liquid phase comprises at least one compound selected from the group consisting of diethylene glycol dinitrate (DEGDN), nitroglycerin, 1,2,4-butanetriol trinitrate (BTTN), trimethylolethane trinitrate (TMETN), N-ethyl-N-(2-nitroxyethyl)nitramine (EtNENA), N-butyl-N-(2-nitroxyethyl)nitramine (BuNENA), a 1:1 mixture of bis(2,2-dinitropropyl)acetal and bis(2,2-dinitropropyl)formal (BDNPA/F), nitromethane, nitroethane, 1-nitropropane, 2-nitropropane, poly(glycidyl azide), 1,5-diazido-3-nitrazapentane and mixtures thereof.

24. An electrothermal-chemical gun system comprising an electrothermal-chemical gun and a propellant comprising a self-contained stable dispersion of at least one energetic solid in at least one energetic liquid phase, said stable dispersion being established prior to deployment of said propellant.

25. The electrothermal-chemical gun system of claim 24 wherein about 20–60 percent by weight of said propellant comprises said dispersed energetic solid and wherein said dispersed energetic solid is selected from the group consisting of nitramines, nitrocellulose, nitroguanidine, ammonium nitrate, pentaerythritol tetranitrate (PETN), trinitrotoluene (TNT) and triaminotrinitrobenzene (TATB).

26. The electrothermal-chemical gun system of claim 24 wherein said energetic liquid phase comprises at least one energetic solid dissolved in at least one homogeneous liquid wherein said energetic solid is selected from the group consisting of nitramines, nitrocellulose, nitroguanidine, ammonium nitrate, pentaerythritol tetranitrate (PETN), trinitrotoluene (TNT) and triaminotrinitrobenzene (TATB).

27. The electrothermal-chemical gun system of claim 26 wherein said nitramine is N-methyl-N-(2-nitroxyethyl)nitramine.

28. The electrothermal-chemical gun system of claim 25 wherein said nitramine is selected from the group consisting of cyclotrimethylenetrinitramine and cyclotetramethylenetetranitramine.

29. The electrothermal-chemical gun system of claim 24 wherein said energetic liquid phase comprises a homogeneous liquid.

30. The electrothermal-chemical gun system of claim 29 further comprising a thickener.

31. The electrothermal-chemical gun system of claim 29 wherein said homogeneous liquid comprises a non-aqueous liquid phase comprising at least one compound selected from the group consisting of nitrate ester, nitramine, nitro or azido compounds.

32. The electrothermal-chemical gun system of claim 31 further comprising a thickener.

33. The electrothermal-chemical gun system of claim 31 wherein said non-aqueous liquid phase comprises at least one compound selected from the group consisting of diethylene glycol dinitrate (DEGDN), nitroglycerin, 1,2,4-butanetriol trinitrate (BTTN), trimethylolethane trinitrate (TMETN), N-ethyl-N-(2-nitroxyethyl)nitramine (EtNENA), N-butyl-N-(2-nitroxyethyl)nitramine (BuNENA), a 1:1 mixture of bis(2,2-dinitropropyl)acetal and bis(2,2-dinitropropyl)formal (BDNPA/F), nitromethane, nitroethane, 1-nitropropane, 2-nitropropane, poly(glycidyl azide) and 1,5-diazido-3-nitrazapentane.

34. An electrothermal-chemical gun system comprising electrothermal-chemical gun and a propellant comprising a dispersion of at least one energetic solid in at least one homogenous energetic liquid phase, wherein said homogeneous liquid phase comprises a concentrated solution containing at least one nitrate salt selected from the group consisting of ammonium nitrate, N-methylammonium nitrate, N-ethylammonium nitrate, ethylenediamine dinitrate and N-(2-hydroxyethyl) ammonium nitrate.

35. An electrothermal-chemical gun system comprising electrothermal-chemical gun and a propellant comprising a dispersion of at least one energetic solid in at least one homogenous energetic aqueous liquid phase, wherein said homogeneous liquid phase comprises a concentrated solution containing at least one nitrate salt selected from the group consisting of ammonium nitrate, N-methylammonium nitrate, N-ethylammonium nitrate, ethylenediamine dinitrate and N-(2-hydroxyethyl) ammonium nitrate; and wherein said aqueous liquid phase further comprises a thickener selected from the group consisting of guar gum and derivatives of guar gum.

* * * * *